US005779607A

United States Patent [19]

Harris

[11] Patent Number: 5,779,607

[45] Date of Patent: Jul. 14, 1998

[54] ABDOMINAL EXERCISE MACHINE ADAPTED FOR STRENGTH EXERCISES

[76] Inventor: Robert W. Harris, 209 W. Woodridge Dr., Durham, N.C. 27707

[21] Appl. No.: 781,356

[22] Filed: Jan. 21, 1997

[51] Int. Cl.[6] ..... A63B 23/02

[52] U.S. Cl. ..... 482/140; 482/95; 482/131; 482/142; 482/907

[58] Field of Search ..... 452/55, 92, 93, 452/95, 96, 131–134, 139, 140, 142, 145, 148, 907, 908; 601/23, 33; D21/190, 191

[56] References Cited

U.S. PATENT DOCUMENTS

| | | | |
|---|---|---|---|
| 2,924,456 | 2/1960 | Miller | 482/96 |
| 4,489,936 | 12/1984 | Dal Monte . | |
| 5,076,579 | 12/1991 | Rickey | 482/95 |
| 5,346,447 | 9/1994 | Stearns . | |
| 5,492,520 | 2/1996 | Brown . | |
| 5,527,249 | 6/1996 | Harris . | |
| 5,545,114 | 8/1996 | Gvoich | 482/140 |
| 5,580,340 | 12/1996 | Yu | 482/93 |
| 5,702,334 | 12/1997 | Lee | 482/95 |

*Primary Examiner*—Jeanne M. Clark
*Attorney, Agent, or Firm*—Jenkins & Wilson, P.A.

[57] ABSTRACT

A novel abdominal exercise machine is provided which is adaptable for a variety of strength exercises utilizing at least some of the weight of a user for resistance. The exercise machine includes a first frame having laterally spaced and parallel side arms adapted for at least partially receiving a user in a supine position therebetween for abdominal exercise. A second frame is pivotally attached to one side of the first frame and includes a support member for at least partially supporting a user's weight thereon during utilization of the exercise machine. When utilized for abdominal exercise, the support member can support a user's head thereon. When utilized for a variety of strength exercises, the support member can support at least some or all of the weight of a user thereon wherein the user can stand, sit, or kneel on the support member. The amount of resistance encountered during strength exercises can be selectively adjusted. The exercise machine additionally includes a handlebar pivotally attached to the same side of the first frame as the second frame but on an opposite end of the first frame from the location of attachment of the second frame to the first frame.

18 Claims, 6 Drawing Sheets

ABDOMINAL EXERCISE MACHINE ADAPTED FOR STRENGTH EXERCISES

TECHNICAL FIELD

The present invention relates generally to exercise machines, and more particularly, to exercise machines adapted for utilization for abdominal exercise as well as for strength exercises against the body weight of a user.

RELATED ART

A variety of exercise machines have been developed for exercising particular muscles of the human body, and the popularity of exercise machines has increased in light of the recognition of the significant benefits that can result from exercising muscles of the human body. Of the exercises machines that have been developed, a number of them are adapted for exercising the muscles of the abdomen in what is commonly referred to as a "sit-up" exercise. Such exercise machines have typically permitted various types of abdominal flexion exercises requiring a user's upper torso to flex in a curling and uncurling manner for particular exercise of abdominal muscles. Other exercise machines that have been developed utilize a user's own body weight at least as a part of the load weight and/or resistance of the machine during performance of a variety of strength exercises. Unfortunately, exercise machines adapted for abdominal exercise typically do not also provide for strength exercises.

U.S. Pat. No. 4,489,936 to Dal Monte discloses a gymnastic implement adaptable for various body muscle exercises wherein resistance to the muscular action is represented by a user's weight. The gymnastic implement includes a board for receiving a user's body in extended position and a frame member otherwise associable to the board and forming in its whole a lever system. The frame member has a first pair of parallel rods lying on a common plane, a second pair of parallel rods also lying on a common plane but inclined relative to the plane of the first pair of rods, and an element interconnecting the rods of the first and second pairs transversely arranged relative to the board and forming the fulcrum. The resistance encountered during exercise depends on the location of the user relative to the lever system. A significant drawback to the apparatus of Dal Monte is that the lever mechanism or arm must be relocated to a different pivot axis and therefore to a different position relative to the user. A user would therefore have much difficulty using consistent form as resistance is varied.

U.S. Pat. No. 5,346,447 to Stearns discloses a variable resistance exercise machine including a platform utilized to support a user in a reclining or supine position with the weight of the user providing resistance to exercise utilizing the exercise machine. In one embodiment, a lever is pivoted to one end of the platform and a plurality of pivot axes on the lever permit selection of a predetermined fulcrum point for the lever. Upon pivoting of the upper exterior end of the lever by the user, the lower end rolls on the exercise surface, thereby raising the adjacent end of the platform along with the body of the user. By varying the pivot axis or fulcrum point, resistance can likewise be varied. In other embodiments, the lever arm includes a pivoting foot instead of rollers. It should be noted, however, that these embodiments require a ground-supported frame to which the pivoting foot is attached and to which the user support means is pivotally attached.

An exercise device adapted specifically for abdominal exercise is disclosed in U.S. Pat. No. 5,492,520 to Brown. The abdominal exerciser device disclosed therein utilizes a one-piece skeletal frame including a pair of support rails, a pair of arcuate rocker portions, a pair of arm rest portions and an upstanding arch-shaped portion connecting the support rails together. The rocker portions are curved on a circular arc to mimic the curvature of a user's spine, and a user can engage in a sit-up type of abdominal exercise while disposed between the support rails in a supine position with the user's head and neck supported on a support extending between the support rails, the elbows of the user received upon the top of the arm rest portions and the hands of a user engaging the upstanding arch-shaped portion connecting the support rails together. As the user curls and uncurls his upper body, the machine is forced to rock in such a way as to provide continuous head support and to promote consistent exercise form.

Neither the apparatus of Dal Monte nor the apparatus of Stearns teaches how to keep the present versatility of such apparatuses while also easily adapting them to enable a user to perform abdominal exercises with continuous head support. Nor does the apparatus of Brown provide any way of accommodating a variety of strength exercises.

So despite the existence of a variety of exercise machines such as those described hereinabove for utilization in abdominal exercise or strength exercises, there exists much room for improvement in the art of exercise machines. Particularly, there exists a need for an improved abdominal exercise machine which provides head support and promotes consistent exercise form, and which is adaptable for a variety of strength exercises utilizing at least in part the weight of a user.

DISCLOSURE OF THE INVENTION

In accordance with the present invention, a novel abdominal exercise machine is provided which is adaptable in one exercise configuration for abdominal exercise and adaptable in a second exercise configuration for a variety of strength exercises utilizing at least in part the weight of a user. The exercise machine comprises a first frame having first and second ends and including at least a pair of laterally spaced-apart side arms adapted for receiving a user in a supine position therebetween at least in the first exercise configuration. A second frame is provided having first and second ends wherein the first end of the second frame is pivotally attached proximate the first end of the first frame and includes support means thereon adapted for at least partially supporting a person's weight thereon. The second frame is attached to the first frame such that the second frame is pivotally movable on one side of the first frame. Handle bar means is pivotally attached to and on one side of the first frame proximate the second end of the first frame.

In the preferred embodiment, the first ends of the side arms of the first frame, which at least in part form the first end of the first frame, are telescopically extendable and retractable and have pivot members pivotally attached thereto. Additionally, the second end of the second frame includes rollers attached thereto.

When the exercise machine is operable for abdominal exercise movement in the first exercise configuration, the second frame is essentially nested within the first frame, with the second end of the second frame being supported by support rods extending inwardly from the first frame proximate the second end thereof. A user can be positioned on an exercise surface in a supine position between the side arms of the first and second frames with his head and neck being supported on the support means of the second frame and with his arms extended such that at least portions of his arms or hands can engage and push the handle bar means in a direction toward the user's knees to force the exercise machine to pivot about the second end of the first frame on the exercise surface during abdominal exercise.

The exercise machine is optionally operable for strength exercise movement in the second exercise configuration. In this configuration, the second frame is no longer nested within the first frame, but instead is positioned such that the second end of the second frame is spaced apart from the second end of the first frame. In this configuration, the rollers on the second end of the second frame now engage the exercise surface, and are free to roll thereon. A user can place at least part of his weight on the support means of the second frame and grasp and move the handle bar means to move and pivot the first frame upwardly and rearwardly about the stationary pivotal members. During this movement, the first end of the second frame, which is pivotally attached to the first frame, is forced to rotate upwardly and rearwardly, with the surface-engaging rollers providing a movable pivot for the second frame.

It is therefore an object of the present invention to provide a novel abdominal exercise machine adapted for a variety of strength exercises.

It is another object of the present invention to provide an abdominal exercise machine adaptable for a variety of strength exercises wherein a user's weight can be utilized as resistance for the variety of strength exercises and wherein the resistance can be varied.

It is a further object of the present invention to provide an abdominal exercise machine adaptable for a variety of strength exercises wherein the exercise machine enables a user to use consistent form for abdominal exercises as well as a variety of strength exercises.

Some of the objects of the invention having been stated hereinabove, other objects will become evident as the description proceeds, when taken in connection with the accompanying drawings as best described hereinbelow.

BEST MODE FOR CARRYING OUT THE INVENTION

Figure 1:
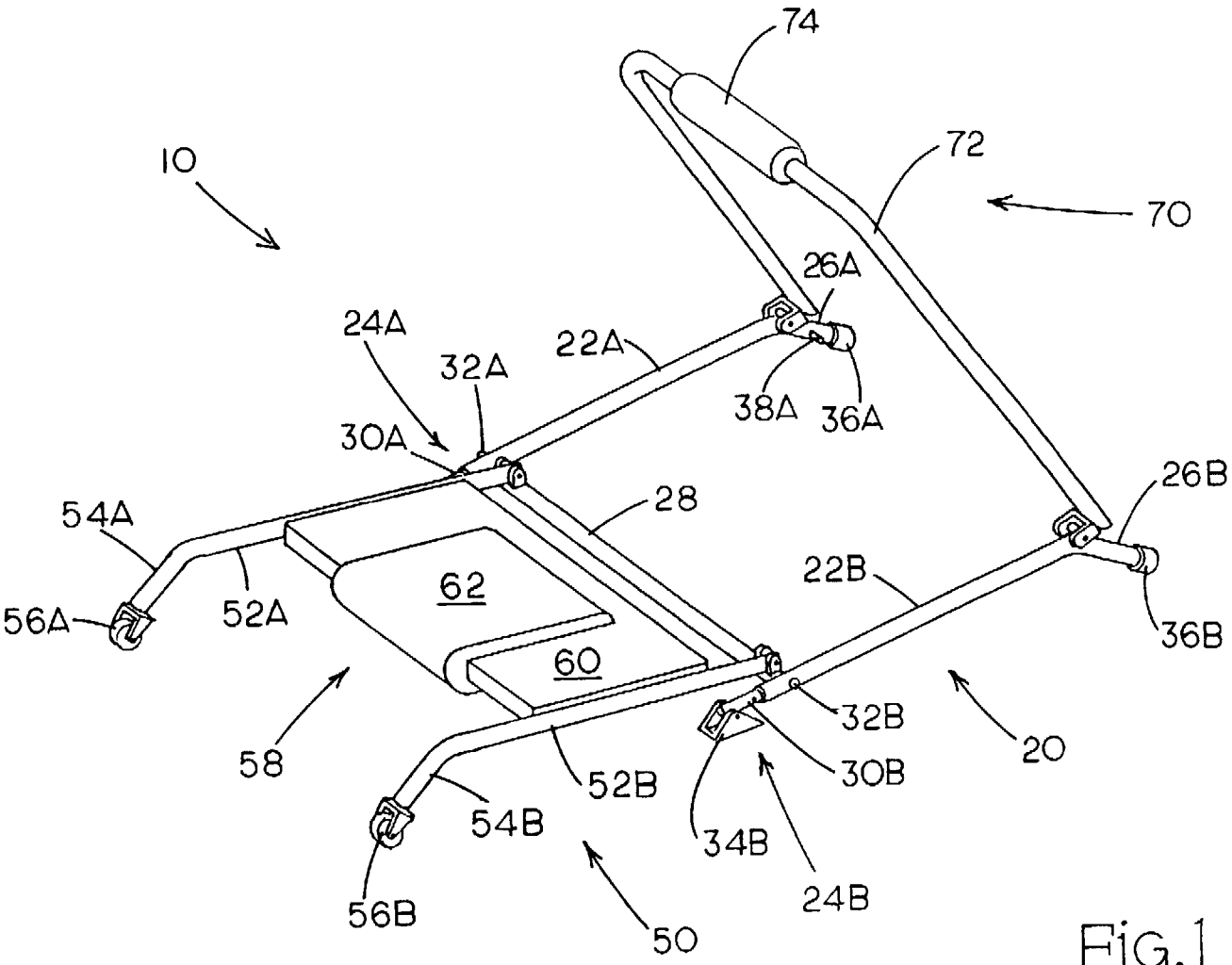
FIG. 1 of the drawings is a perspective view of a preferred embodiment of the exercise machine according to the present invention in a configuration adapted for a variety of strength exercises.

Referring now to FIGS. 1–4B of the drawings, a preferred embodiment of the exercise machine according to the present invention is illustrated and generally designated 10. Exercise machine 10 is preferably light weight and compact to facilitate easy and convenient use, although it is envisioned in accordance with this invention that exercise machine 10 could be constructed of heavier materials in a design adapted for commercial usage. According to the present invention, exercise machine 10 is adapted for abdominal exercise in a first exercise configuration and adapted for a variety of strength exercises in a second exercise configuration, as further described hereinbelow.

Exercise machine 10 comprises a first frame generally designated 20, a second frame generally designated 50 and handlebar means generally designated 70. First frame 20 comprises a pair of identical, laterally spaced and parallel side arms 22A and 22B, having first ends generally designated 24A and 24B, respectively, and second ends 26A and 26B, respectively. A transverse arm 28 is attached to and extends between side arms 22A and 22B proximate first ends 24A and 24B, respectively. Side arms 22A and 22B and transverse arm 28 can be constructed of any suitable material such as metal or plastic.

In accordance with this invention, first ends 24A and 24B of side arms 22A and 22B, respectively, are selectively telescopically extendable and retractable as side arms 22A and 22B include narrower sliding portions 30A and 30B, respectively, which are telescopically slidable from side arms 22A and 22B. Sliding portions 30A and 30B can define a plurality of spaced-apart apertures therein, and removable pins 32A and 32B of side arms 22A and 22B, respectively, can be received through the apertures of sliding portions 30A and 30B, respectively, in order to selectively maintain sliding portions 30A and 30B in desired positions of predetermined distances of extension from side arms 22A and 22B, respectively. Pins 32A and 32B are therefore adapted to be removably positioned through apertures defined through side arms 22A and 22B, respectively.

Attached to sliding portions 30A and 30B at least proximate exposed ends thereof are pivot members 34A and 34B, respectively. Pivot members 34A and 34B can include flat bottom surfaces for engaging an exercise surface during certain uses of exercise machine 10 in accordance with this invention. Pivot members 34A and 34B are pivotally attached to sliding portions 30A and 30B such that sliding portions 30A and 30B, as well as side arms 22A and 22B, are pivotally movable about pivot members 34A and 34B, respectively, while pivot members 34A and 34B are in a stationary position.

Second ends 26A and 26B of side arms 22A and 22B, respectively, are preferably angled and include end covers 36A and 36B, respectively, adapted for engaging an exercise surface during certain uses of exercise machine 10 as described further hereinbelow. Support rods 38A and 38B (not shown) extend from second ends 26A and 26B of side arms of 22A and 22B, respectively. As described further hereinbelow, support rods 38A and 38B are adapted for engaging and supporting the second end of second frame 50 when exercise machine 10 is in the first exercise configuration adapted for abdominal exercise.

Second frame 50 is pivotally attached to one side of first frame 20 so as to preferably be pivotally movable approximately 180°. Second frame 50 preferably comprises a pair of laterally spaced side arms 52A and 52B which are parallel to one another and, like side arms 22A and 22B, can be constructed of any suitable material such as metal or plastic. Side arms 52A and 52B include angled ends 54A and 54B, respectively, opposite the ends of side arms 52A and 52B attached to first frame 20. Angled ends 54A and 54B have rollers 56A and 56B, respectively, attached thereto. Second frame 50 further comprises support means generally designated 58 which includes platform 60 attached to and extending between side arms 52A and 52B such that support means 58 can be moved identically and simultaneously with movement of side arms 52A and 52B. Support means 58 includes a pad covering 62 thereon and is adapted for supporting at least a portion of a user's weight thereon during use of exercise machine 10. As described further hereinbelow, when exercise machine 10 is adapted for abdominal exercise in the first exercise configuration, support means 58, particularly pad covering 62, can support a user's head thereon during abdominal exercise. Also as discussed further hereinbelow, when exercise machine 10 is adapted for a variety of strength exercises in the second exercise configuration, support means 58 can receive some or all of a user's weight thereon wherein the user can sit, kneel, or stand on support means 58.

Handlebar means 70 is attached to first frame 20 proximate second ends 26A and 26B thereof. Handlebar means 70 is pivotally attached to first frame 20 so as to be pivotally movable on the same side thereof that second frame 50 is pivotally movable on. From an essentially vertical position, the movement of handlebar means 70 is restricted, relative to first frame 20, to downward and rearward rotation. In the preferred embodiment, handlebar means 70 comprises a single arcuate arm 72 and can include a sleeve portion 74 around the upper portion thereof for providing a cushion for engagement of handlebar means 70 by a user.

ABDOMINAL EXERCISE

Figure 2:
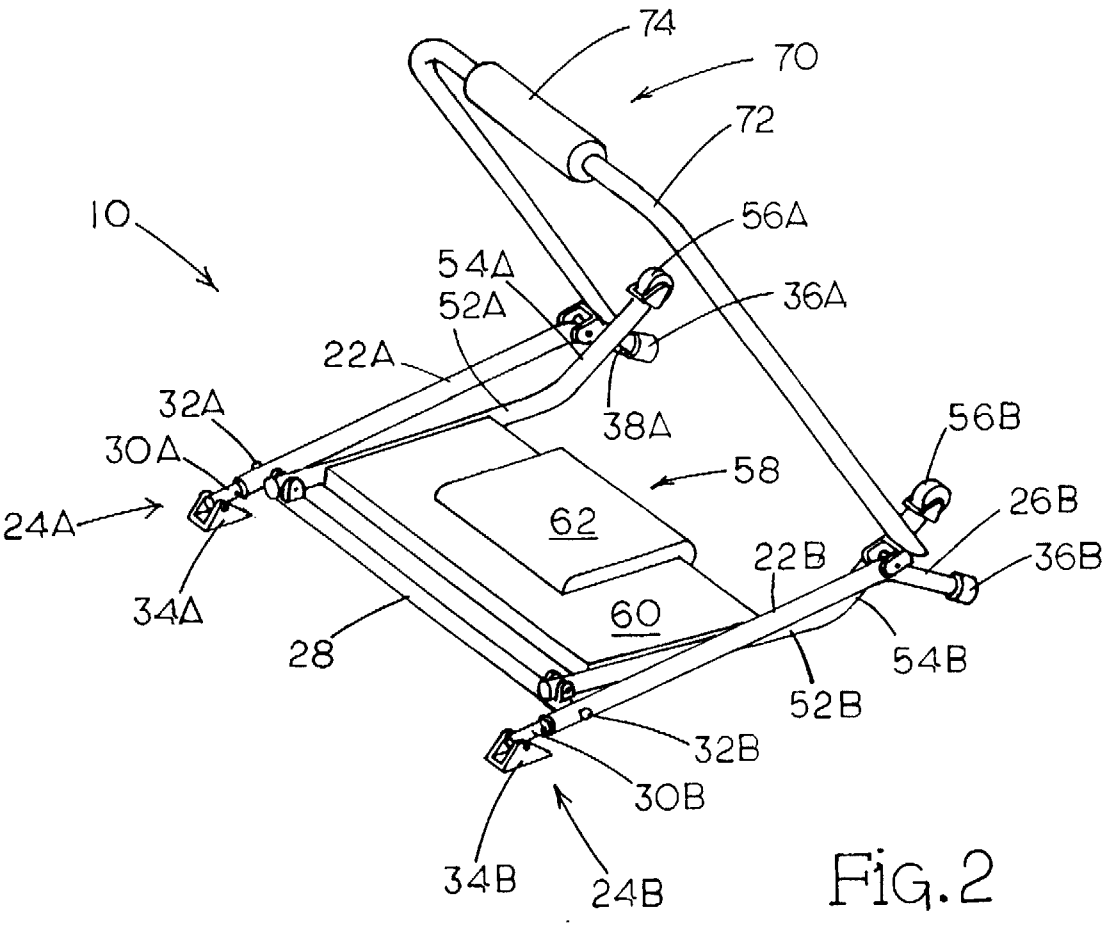
FIG. 2 of the drawings is a perspective view of the exercise machine of FIG. 1 shown in a configuration adapted for abdominal exercises.
Figure 3A:
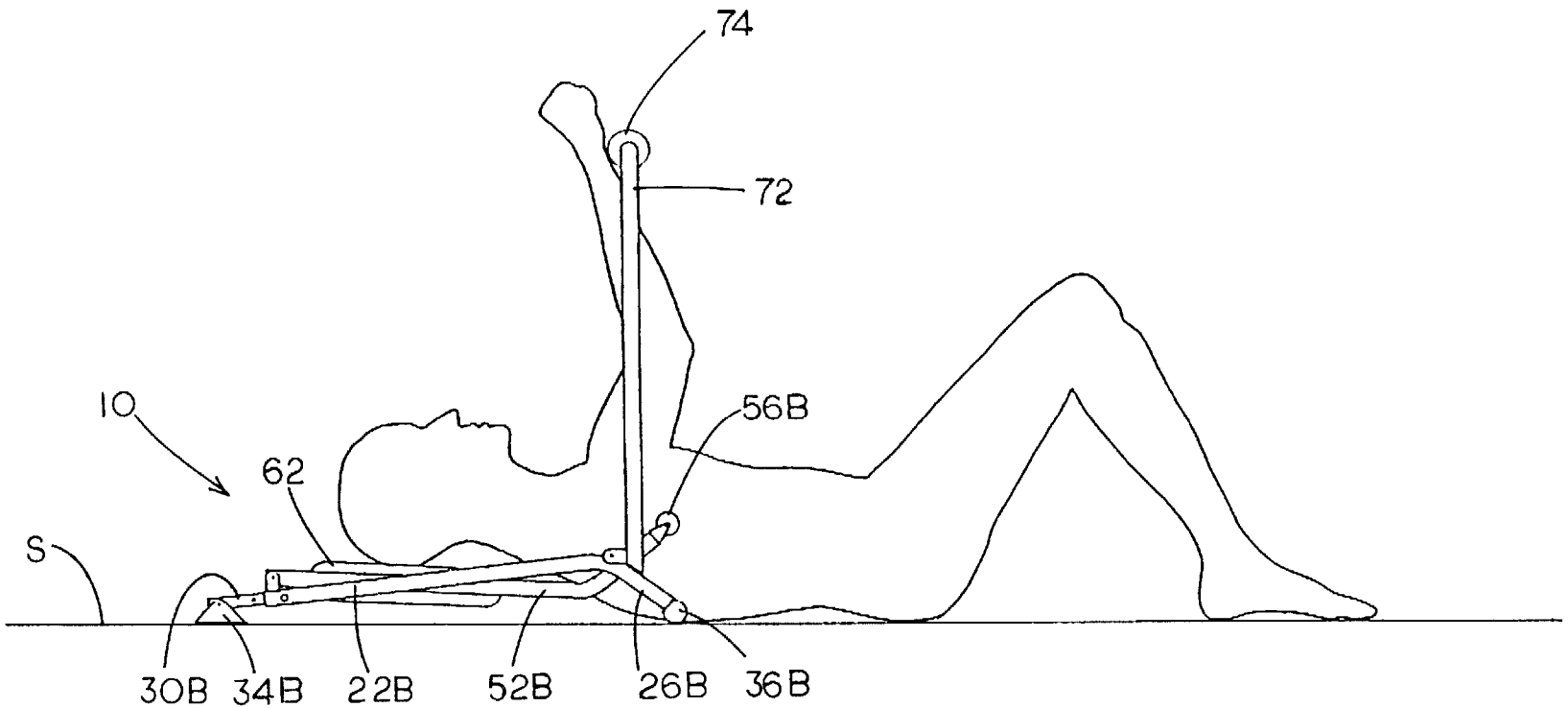
FIG. 3A of the drawings is a side view of the exercise machine in the configuration shown in FIG. 2 with a user in a ready position for engaging in abdominal exercise.
Figure 3B:
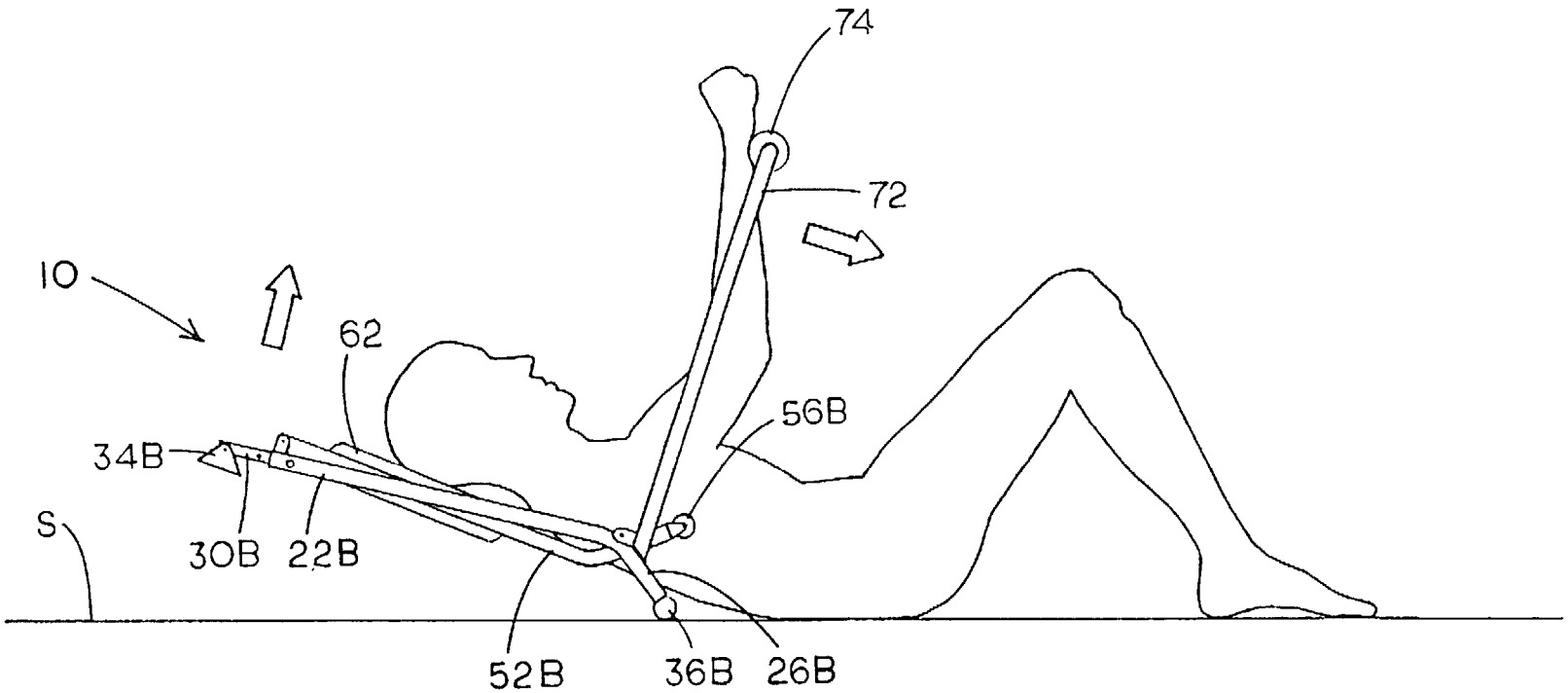
FIG. 3B of the drawings is a side view of the exercise machine and user of FIG. 3A during abdominal exercise.

Exercise machine 10 can be used for abdominal exercise in a first exercise configuration. Referring specifically to FIGS. 2, 3A and 3B of the drawings, wherein exercise machine 10 is shown in the first exercise configuration adapted for abdominal exercise, second frame 50 is positioned such that it is substantially nested between side arms 22A and 22B of first frame 20 in a generally parallel relationship therewith. Side arms 52A and 52B of second frame 50 are positioned between side arms 22A and 22B of first frame 20 wherein angled ends 54A and 54B of side arms 52A and 52B, respectively, are positioned against and supported at least in part by support rods 38A and 38B (not shown) of side arms 22A and 22B, respectively. Support means 58 is therefore also positioned between side arms 22A and 22B of first frame 20.

Referring now specifically to FIGS. 3A and 3B of the drawings, exercise machine 10 is positioned on an exercise surface S, and a user is lying on exercise surface S with the head of the user supported on pad covering 62 of support means 58. The head, neck and upper body portion of the user are positioned between side arms 22A and 22B of first frame 20 as well as between side arms 52A and 52B of second frame 50. As shown in FIG. 3A, the arms of the user are extended upwardly generally perpendicular to the body of the user, and the wrists of the user are positioned against and engage sleeve portion 74 of arm 72. Pivot members 34A and 34B of first frame 20 as well as end covers 36A and 36B of first frame 20 engage exercise surface S and support exercise machine 10 thereon. In this position, the user is ready to utilize exercise machine 10 for abdominal exercise.

Once in the ready position as described hereinabove and illustrated in FIG. 3A, the user can engage in abdominal exercise by contracting his abdominal muscles and concurrently pushing arm 72, such as by pushing sleeve portion 74, in a forward direction generally toward the user's raised knees as illustrated in FIG. 3B of the drawings. Because arm 72 cannot rotate in a forward direction relative to first frame 20, pushing arm 72 forward forces exercise machine 10 to pivot on end covers 36A and 36B which remain on exercise surface S while side arms 22A and 22B of first frame 20 (and pivot members 34A and 34B thereon), side arms 52A and 52B of second frame 50, and support means 58 with the user's head on pad covering 62 thereof all simultaneously move in a generally upward direction toward the former location of arm 72 of handle bar means 70. As the abdominal exercise continues, such movement of exercise machine 10 also continues until the abdominal exercise reaches a point of maximum contraction. The user can then lie back toward and on exercise surface S to the original ready position shown in FIG. 3A whereby exercise machine 10 simultaneously pivots on end covers 36A and 36B and moves back to its original ready position shown in FIG. 3A. The head of the user can therefore be supported at all times on pad covering 62 attached to platform 60.

STRENGTH EXERCISES

Figure 4A:
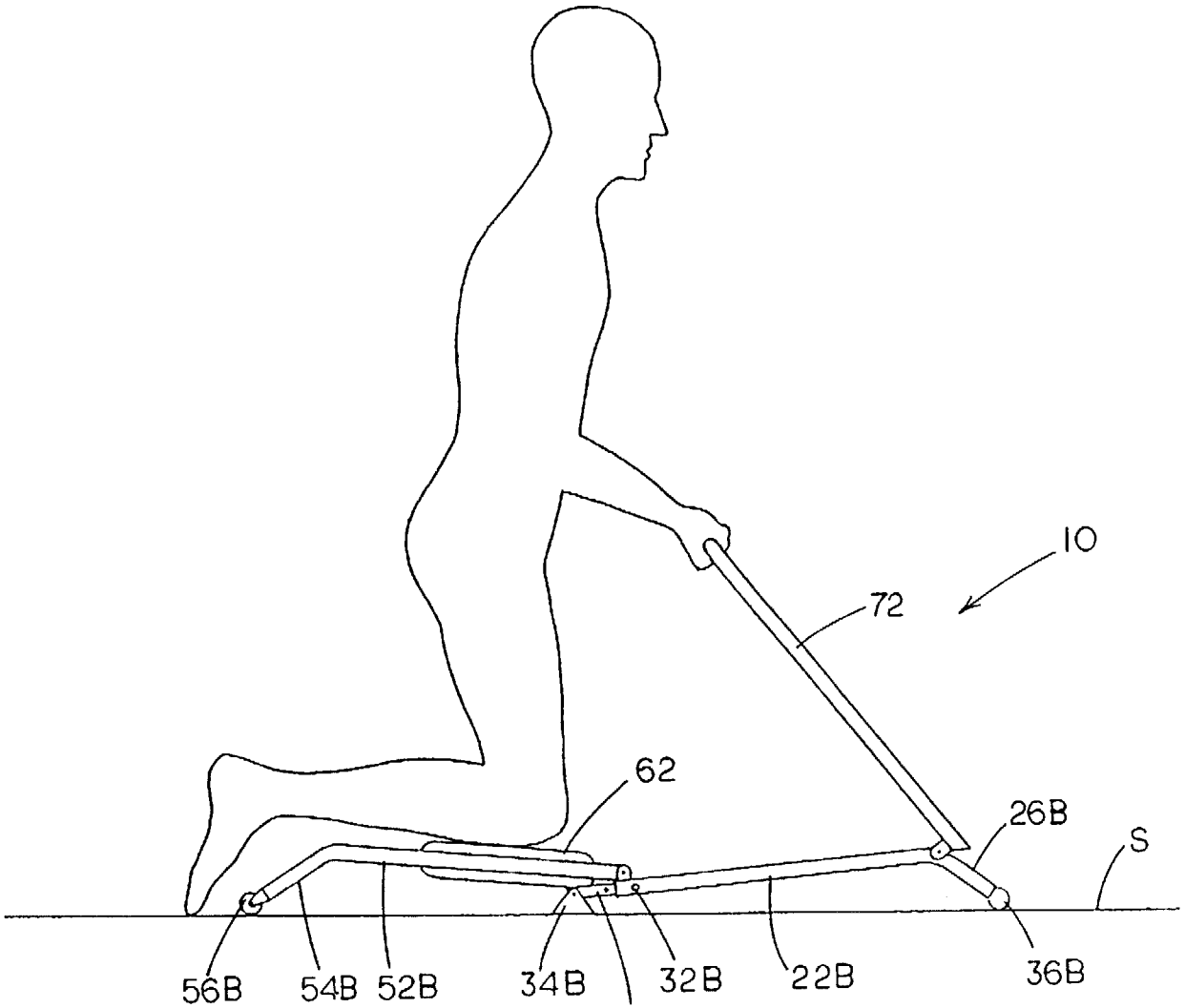
FIG. 4A of the drawings is a side view of the exercise machine in a configuration for strength exercises with a user in a ready position for engaging in a strength exercise.
Figure 4B:
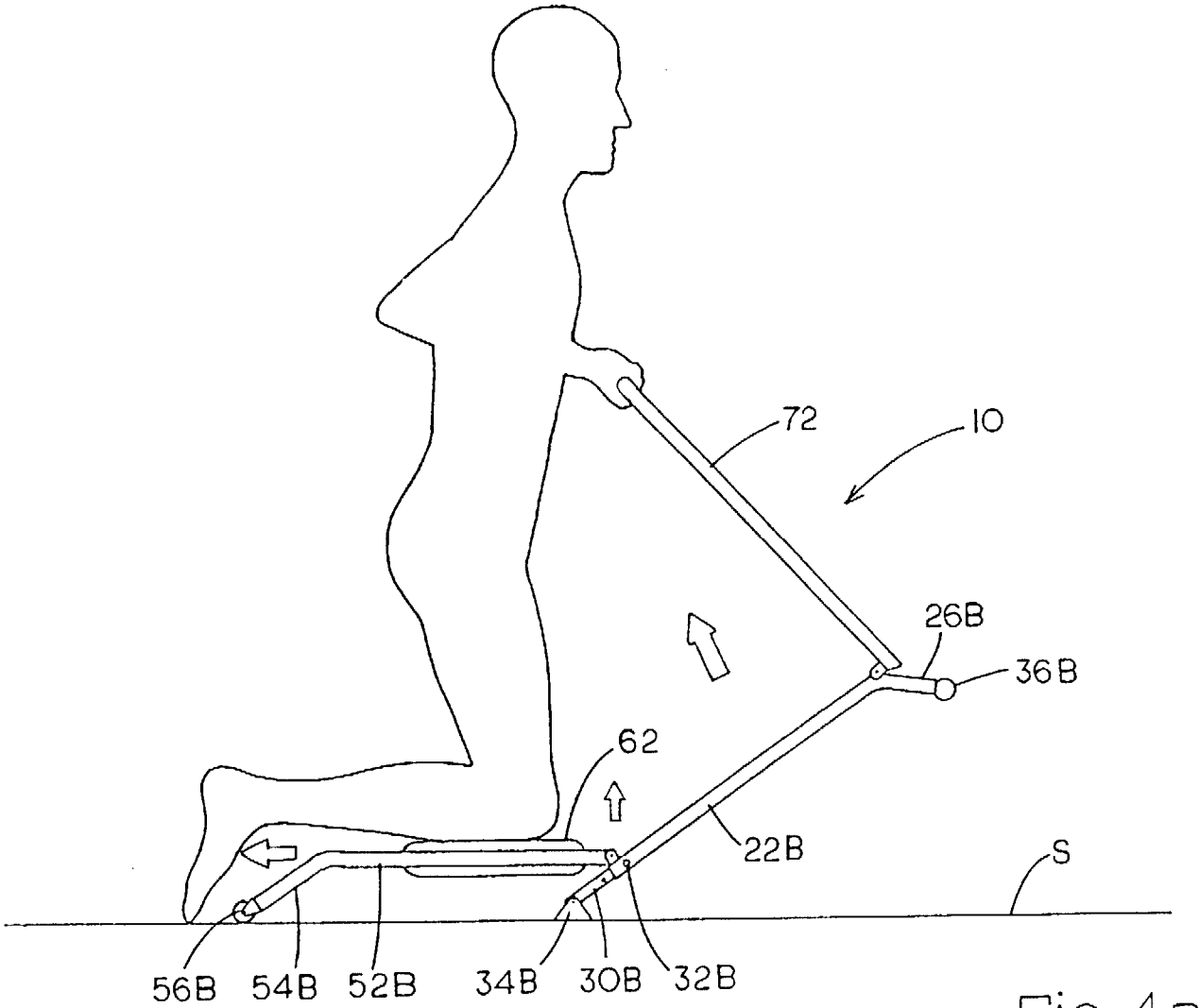
FIG. 4B of the drawings is a side view of the exercise machine and user of FIG. 4A with the user engaging in a strength exercise.

In accordance with this invention, exercise machine 10 can be utilized by a user for a variety of strength exercises in the second exercise configuration. Referring to FIGS. 1, 4A and 4B of the drawings, second frame 50 of exercise machine 10 is extended away from first frame 20 such that side arms 52A and 52B of second frame 50 are no longer nested within first frame 20. Angled ends 54A and 54B of side members 52A and 52B, respectively, and second ends 26A and 26B of side arms 22A and 22B, respectively, are spaced apart at opposite ends of exercise machine 10 with the pivotal point of connection of side arms 52A and 52B to transverse arm 28 located therebetween as best illustrated in FIGS. 1 and 4A of the drawings. Support means 58 of second frame 50 is therefore not positioned directly between side arms 22A and 22B of first frame 20.

Referring specifically to FIG. 4A, a user can kneel on support means 58 (platform 60 and/or pad covering 62) of second frame 50 as exercise machine 10 is supported on exercise surface B by the positioning and engagement of rollers 56A and 56B, pivot members 24A and 24B, and end covers 36A and 36B on exercise surface S. At least some or all of the weight of the user can therefore be supported on support means 58. In accordance with the present invention, it is envisioned that the user can be in various positions on platform 60 and/or pad covering 62 with some or all of the weight of the user supported thereon. Such positions can include, for example, the user standing on platform 60 and/or pad covering 62 or even sitting on platform 60 and/or pad covering 62.

While positioned at least partially on platform 60 and/or pad covering 62 of second frame 50, the user can engage and grasp arm 72 or sleeve portion 74, and the user can thereby pull arm 72 in a generally upward direction for a strength exercise as illustrated in FIG. 4B of the drawings. Upward pulling of arm 72 causes side arms 22A and 22B of first frame 20 to pivot generally upwardly about pivot members 34A and 34B which remain on exercise surface S while the second end of first frame 20 moves generally upwardly toward the user and away from exercise surface S. Second frame 50, and therefore support means 58, pivots generally upwardly and rearwardly about rollers 56A and 56B due to the pivotal attachment of side arms 52A and 52B of second frame 50 to transverse arm 28 of first frame 20. Second frame 50 is permitted to roll on exercise surface S on rollers 56A and 56B of side arms 52A and 52B, respectively. The extent of upward movement of the first end of second frame 50 can be determined and selectively adjusted by the extent or distance of extension of sliding portions 30A and 32B of side arms 22A and 22B, respectively. At least some of the weight of the user can therefore be utilized as resistance to pulling arm 72 and the second end of first frame 20 upwardly and causing second frame 50 to move in an upwardly and rearwardly direction.

When arm 72 has been pulled generally upwardly to a desired extent, the user can then lower arm 72 which allows arm 72, first frame 20, and second frame 50 to return to their original ready positions illustrated in FIG. 4A of the drawings. Some or all of the weight of the user can therefore be supported on support means 58 of second frame 50 at all times during the strength exercise. Exercise apparatus 10 includes adjustable resistance means in the form of selectively adjustable sliding portions 30A and 30B of first frame 20. Adjustment of sliding portions 30A and 30B for further extension understandably increases resistance during strength exercises while less extension understandably decreases resistance.

It can therefore be seen that the present invention provides a novel abdominal exercise machine which can be adapted for utilization in a variety of strength exercises. It can also be seen that the present invention provides an abdominal exercise machine which can be adapted for a variety of strength exercises wherein the resistance during the strength exercises can be provided by at least some or all of the weight of a user. Additionally, it can be appreciated that the present invention provides an abdominal exercise machine adapted for a variety of strength exercises wherein a user can have consistent form for both types of exercises.

It will be understood that various details of the invention may be changed without departing from the scope of the invention. Furthermore, the foregoing description is for the purpose of illustration only, and not for the purpose of limitation as the invention is defined by the following, appended claims.

What is claimed is:

1. An exercise machine operable at least for abdominal exercise in a first exercise configuration and strength exercise in a second exercise configuration, said exercise machine comprising:

(a) a first frame having first and second ends and including at least a pair of laterally spaced-apart side arms adapted for at least partially receiving a user in a supine position therebetween in said first exercise configuration;

(b) a second frame having first and second ends, said first end of said second frame being pivotally attached at least proximate said first end of said first frame and including support means adapted for at least partially supporting a user's weight thereon when said exercise machine is operable for abdominal exercise in said first exercise configuration and when said exercise machine is operable for strength exercise in said second exercise configuration, said second frame being attached to said first frame such that said second frame is pivotally movable relative to said first frame;

(c) handlebar means pivotally attached to and on one side of said first frame proximate said second end of said first frame;

(d) wherein said first exercise configuration comprises said second frame positioned generally parallel to said first frame and supported at least partially thereby with said second end of said second frame proximate said second end of said first frame, and whereby a user performs abdominal exercise by positioning himself on an exercise surface in a supine position at least partially between said side arms of said first frame and with at least the head of the user being supported on said support means and pushing said handlebar means in a direction away from said support means to force said exercise machine to pivot on the exercise surface and support at least the head of the user during abdominal exercise; and (e) wherein said second exercise configuration comprises said second frame positioned such that said second end of said second frame is spaced-apart from said second end of said first frame, and whereby a user performs strength exercise by placing at least part of his weight on said support means and grasping and moving said handlebar means to move and pivot said first frame about said first end of said first frame against the user's weight during strength exercise.

2. The exercise machine of claim 1 further comprising adjustable resistance means for adjusting resistance against which a user moves said handlebar means during strength exercise.

3. The exercise machine of claim 2 wherein said adjustable resistance means comprises said side arms of said first frame being telescopically extendable and retractable proximate said first end of said first frame.

4. The exercise machine of claim 1 wherein said first frame comprises said side arms in a substantially parallel relationship and a transverse arm attached to and extending between said side arms proximate said first end of said first frame.

5. The exercise machine of claim 4 wherein said second frame is pivotally attached to said first frame by pivotal attachment to said transverse arm of said first frame.

6. The exercise machine of claim 4 further comprising pivot plates attached to said first end of said first frame by attachment of one pivot plate to an end of each of said side arms.

7. The exercise machine of claim 6 wherein said side arms are angled at the ends opposite said pivot plates.

8. The exercise machine of claim 4 wherein said first frame further comprises support means for providing support for said second end of said second frame when said exercise machine is in said first exercise configuration.

9. The exercise machine of claim 8 wherein said support means of said first frame comprises support rods extending inwardly from said side arms of said first frame proximate said second end thereof.

10. The exercise machine of claim 1 wherein said second frame is attached to said first frame such that said second frame is pivotal approximately 180° on said one side of said first frame.

11. The exercise machine of claim 1 wherein said second frame comprises substantially parallel side arms pivotally attached to said first frame, and said support means is attached to and extends between said side arms of said second frame.

12. The exercise machine of claim 11 wherein said side arms of said second frame are each angled at ends thereof opposite said first frame and further comprise rollers attached to each angled end of said side arms of said second frame.

13. The exercise machine of claim 1 wherein said handlebar means comprises a single arcuate arm pivotally attached to said first frame.

14. The exercise machine of claim 13 wherein said handlebar means further comprises a sleeve member thereon for cushioning said arcuate arm.

15. An exercise machine operable at least for abdominal exercise in a first exercise configuration and strength exercise in a second exercise configuration, said exercise machine comprising:

(a) a first frame including a pair of laterally spaced and parallel side arms having first and second ends and adapted for receiving a user in a supine position therebetween in said first exercise configuration, said side arms including support rods proximate said second ends thereof, and said first frame further including a transverse arm attached to and extending between said side arms proximate said first ends thereof;

(b) a second frame including laterally spaced and parallel side arms and support means attached to and extending between said side arms of said second frame for at least partially supporting a user's weight thereon when said exercise machine is operable for abdominal exercise in said first exercise configuration and when said exercise machine is operable for strength exercise in said second exercise configuration, said side arms of said second frame being pivotally attached to said transverse arm of said first frame proximate said first end thereof such that said second frame is pivotally movable relative to said first frame and can be positioned on and supported at least partially by said support rods of said first frame;

(c) handlebar means pivotally attached to and on one side of said first frame by pivotal attachment to said side arms of said first frame proximate said second ends thereof;

(d) wherein said first exercise configuration comprises said side arms of said second frame positioned on said support rods of said first frame so as to be supported at least partially thereby, and whereby a user performs abdominal exercise by positioning himself on an exercise surface in a supine position at least partially between said side arms of said first frame and with at least the head of the user being supported on said support means of said second frame and pushing said handlebar means in a direction away from said support means to force said exercise machine to pivot on said second end of said second frame on the exercise surface and support at least the head of the user during abdominal exercise; and (e) wherein said second exercise configuration comprises said second frame positioned such that said side arms of said second frame extend in a direction generally opposite and away from said side arms of said first frame, and whereby a user performs strength exercise by placing at least part of his weight on said support means of said second frame and grasping and moving said handlebar means to move and pivot said first frame about said first end of said first frame against the user's weight during strength exercise.

16. The exercise machine of claim 15 wherein said side arms of said first frame are telescopically extendable and retractable from a location proximate said first ends thereof.

17. The exercise machine of claim 15 further comprising pivot members attached to said first ends of said side members of said first frame.

18. The exercise machine of claim 15 wherein said second frame is attached to said first frame such that said second frame is pivotal approximately 180° on said one side of said first frame.

* * * * *